US008786499B2

(12) United States Patent
Nissinen et al.

(10) Patent No.: US 8,786,499 B2
(45) Date of Patent: Jul. 22, 2014

(54) MULTIBAND ANTENNA SYSTEM AND METHODS

(75) Inventors: Pertti Nissinen, Kempele (FI); Antti Leskelä, Oulu (FI); Jari Perunka, Tupos (FI); Zlatoljub Milosavljevic, Kempele (FI); Petteri Annamaa, Oulunsalo (FI); Kimmo Koskiniemi, Oulu (FI)

(73) Assignee: Pulse Finland Oy, Kempele (FI)

( * ) Notice: Subject to any disclaimer, the term of this patent is extended or adjusted under 35 U.S.C. 154(b) by 1813 days.

(21) Appl. No.: 12/083,129

(22) PCT Filed: Sep. 20, 2006

(86) PCT No.: PCT/FI2006/050403

§ 371 (c)(1),
(2), (4) Date: May 17, 2010

(87) PCT Pub. No.: WO2007/039668

PCT Pub. Date: Apr. 12, 2007

(65) Prior Publication Data

US 2010/0220016 A1 Sep. 2, 2010

(30) Foreign Application Priority Data

Oct. 3, 2005 (FI) ..... 20055527

(51) Int. Cl.
*H01Q 1/24* (2006.01)
*H01Q 21/00* (2006.01)

(52) U.S. Cl.
USPC ..... 343/702; 343/700 MS; 343/853; 343/893

(58) Field of Classification Search
None
See application file for complete search history.

(56) References Cited

U.S. PATENT DOCUMENTS 2,745,102 A 5/1956 Norgorden
3,938,161 A 2/1976 Sanford (Continued)

FOREIGN PATENT DOCUMENTS

CN 1329735 1/2002
CN 02108316.9 3/2003

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Trinh Dinh
(74) *Attorney, Agent, or Firm* — Gazdzinski & Associates, PC

(57) ABSTRACT

An antenna system internal to the device especially intended for small-sized mobile stations, the system having separate operating bands. The system is implemented as decentralized in a way that the device (300) has a plurality of separate antennas (310-360). Each antenna is based on (a) radiating element(s) on the surface of a dielectric substrate. The substrate can be, for example, a piece of ceramics or a part of the outer casing of the device. The antennas are located at suitable places in the device. The operating band of an individual antenna covers the frequency range used by one radio system, the frequency ranges close to each other and is used by two different radio systems or only the transmitting or receiving band of the frequency range used by a radio system. If the device has a shared transmitter and a shared receiver for the radio systems using frequency ranges close to each other, there can anyway be a separate antenna for each system or the antenna can also be shared. The antennas can be made very small, because a relatively small bandwidth is sufficient for an individual antenna, when there is a plurality of antennas. A good matching of the antenna is achieved on the whole width of each radio system, because the matching of a separate antenna having a relatively narrow band is easier to arrange than that of a combined multi-band antenna. No switches are needed in the structure for choosing a sub-band, which contributes to good efficiency for its part.

19 Claims, 5 Drawing Sheets

(56) References Cited

U.S. PATENT DOCUMENTS

| | | | |
|---|---|---|---|
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |
| 4,653,889 | A | 3/1987 | Bizouard et al. |
| 4,661,992 | A | 4/1987 | Garay et al. |
| 4,692,726 | A | 9/1987 | Green et al. |
| 4,703,291 | A | 10/1987 | Nishikawa et al. |
| 4,706,050 | A | 11/1987 | Andrews |
| 4,716,391 | A | 12/1987 | Moutrie et al. |
| 4,740,765 | A | 4/1988 | Ishikawa et al. |
| 4,742,562 | A | 5/1988 | Kommrusch |
| 4,761,624 | A | 8/1988 | Igarashi et al. |
| 4,800,348 | A | 1/1989 | Rosar et al. |
| 4,800,392 | A | 1/1989 | Garay et al. |
| 4,821,006 | A | 4/1989 | Ishikawa et al. |
| 4,823,098 | A | 4/1989 | DeMuro et al. |
| 4,827,266 | A | 5/1989 | Sato et al. |
| 4,829,274 | A | 5/1989 | Green et al. |
| 4,862,181 | A | 8/1989 | PonceDeLeon et al. |
| 4,879,533 | A | 11/1989 | De Muro et al. |
| 4,896,124 | A | 1/1990 | Schwent |
| 4,954,796 | A | 9/1990 | Green et al. |
| 4,965,537 | A | 10/1990 | Kommrusch |
| 4,977,383 | A | 12/1990 | Niiranen |
| 4,980,694 | A | 12/1990 | Hines |
| 5,017,932 | A | 5/1991 | Ushiyama et al. |
| 5,043,738 | A | 8/1991 | Shapiro et al. |
| 5,047,739 | A | 9/1991 | Kuokkanene |
| 5,053,786 | A | 10/1991 | Silverman et al. |
| 5,097,236 | A | 3/1992 | Wakino et al. |
| 5,103,197 | A | 4/1992 | Turunen |
| 5,109,536 | A | 4/1992 | Kommrusch |
| 5,155,493 | A | 10/1992 | Thursby et al. |
| 5,157,363 | A | 10/1992 | Puurunen |
| 5,159,303 | A | 10/1992 | Flink |
| 5,166,697 | A | 11/1992 | Viladevall et al. |
| 5,170,173 | A | 12/1992 | Krenz et al. |
| 5,203,021 | A | 4/1993 | Repplinger et al. |
| 5,210,510 | A | 5/1993 | Karsikas |
| 5,210,542 | A | 5/1993 | Pett et al. |
| 5,220,335 | A | 6/1993 | Huang |
| 5,229,777 | A | 7/1993 | Doyle |
| 5,239,279 | A | 8/1993 | Turunen |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen |
| 5,304,968 | A | 4/1994 | Ohtonen |
| 5,307,036 | A | 4/1994 | Turunen |
| 5,319,328 | A | 6/1994 | Turunen |
| 5,349,315 | A | 9/1994 | Ala-Kojola |
| 5,349,700 | A | 9/1994 | Parker |
| 5,351,023 | A | 9/1994 | Niiranen |
| 5,354,463 | A | 10/1994 | Turunen |
| 5,355,142 | A | 10/1994 | Marshall et al. |
| 5,357,262 | A | 10/1994 | Blaese |
| 5,363,114 | A | 11/1994 | Shoemaker |
| 5,369,782 | A | 11/1994 | Kawano et al. |
| 5,382,959 | A | 1/1995 | Pett et al. |
| 5,386,214 | A | 1/1995 | Sugawara |
| 5,387,886 | A | 2/1995 | Takalo |
| 5,389,937 | A | 2/1995 | Kaloi |
| 5,394,162 | A | 2/1995 | Korovesis et al. |
| RE34,898 | E | 4/1995 | Turunen |
| 5,408,206 | A | 4/1995 | Turunen |
| 5,418,508 | A | 5/1995 | Puurunen |
| 5,432,489 | A | 7/1995 | Yrjola |
| 5,438,697 | A | 8/1995 | Fowler et al. |
| 5,440,315 | A | 8/1995 | Wright et al. |
| 5,442,366 | A | 8/1995 | Sanford |
| 5,444,453 | A | 8/1995 | Lalezari |
| 5,467,065 | A | 11/1995 | Turunen |
| 5,473,295 | A | 12/1995 | Turunen |
| 5,506,654 | A | 4/1996 | Ala-Kojola |
| 5,508,668 | A | 4/1996 | Prokkola |
| 5,517,683 | A | 5/1996 | Collett et al. |
| 5,521,561 | A | 5/1996 | Yrjola |
| 5,532,703 | A | 7/1996 | Stephens et al. |
| 5,541,560 | A | 7/1996 | Turunen |
| 5,541,617 | A | 7/1996 | Connolly et al. |
| 5,543,764 | A | 8/1996 | Turunen |
| 5,550,519 | A | 8/1996 | Korpela |
| 5,557,287 | A | 9/1996 | Pottala et al. |
| 5,557,292 | A | 9/1996 | Nygren et al. |
| 5,570,071 | A | 10/1996 | Ervasti |
| 5,585,771 | A | 12/1996 | Ervasti |
| 5,585,810 | A | 12/1996 | Tsuru et al. |
| 5,589,844 | A | 12/1996 | Belcher et al. |
| 5,594,395 | A | 1/1997 | Niiranen |
| 5,604,471 | A | 2/1997 | Rattila |
| 5,627,502 | A | 5/1997 | Ervasti |
| 5,649,316 | A | 7/1997 | Prodhomme et al. |
| 5,668,561 | A | 9/1997 | Perrotta et al. |
| 5,675,301 | A | 10/1997 | Nappa |
| 5,689,221 | A | 11/1997 | Niiranen |
| 5,694,135 | A | 12/1997 | Dikun et al. |
| 5,703,600 | A | 12/1997 | Burrell et al. |
| 5,709,823 | A | 1/1998 | Hayes et al. |
| 5,711,014 | A | 1/1998 | Crowley et al. |
| 5,717,368 | A | 2/1998 | Niiranen |
| 5,731,749 | A | 3/1998 | Yrjola |
| 5,734,305 | A | 3/1998 | Ervasti |
| 5,734,350 | A | 3/1998 | Deming et al. |
| 5,734,351 | A | 3/1998 | Ojantakanen |
| 5,739,735 | A | 4/1998 | Pyykko |
| 5,742,259 | A | 4/1998 | Annamaa |
| 5,757,327 | A | 5/1998 | Yajima et al. |
| 5,764,190 | A | 6/1998 | Murch et al. |
| 5,767,809 | A | 6/1998 | Chuang et al. |
| 5,768,217 | A | 6/1998 | Sonoda et al. |
| 5,777,581 | A | 7/1998 | Lilly et al. |
| 5,777,585 | A | 7/1998 | Tsuda et al. |
| 5,793,269 | A | 8/1998 | Ervasti |
| 5,812,094 | A | 9/1998 | Maldonado |
| 5,815,048 | A | 9/1998 | Ala-Kojola |
| 5,822,705 | A | 10/1998 | Lehtola |
| 5,852,421 | A | 12/1998 | Maldonado |
| 5,861,854 | A | 1/1999 | Kawahata et al. |
| 5,874,926 | A | 2/1999 | Tsuru et al. |
| 5,880,697 | A | 3/1999 | McCarrick et al. |
| 5,886,668 | A | 3/1999 | Pedersen et al. |
| 5,892,490 | A | 4/1999 | Asakura et al. |
| 5,903,820 | A | 5/1999 | Hagstrom |
| 5,905,475 | A | 5/1999 | Annamaa |
| 5,920,290 | A | 7/1999 | McDonough et al. |
| 5,926,139 | A | 7/1999 | Korisch |
| 5,929,813 | A | 7/1999 | Eggleston |
| 5,936,583 | A | 8/1999 | Tadahiko et al. |
| 5,943,016 | A | 8/1999 | Snyder, Jr. et al. |
| 5,952,975 | A | 9/1999 | Pedersen et al. |
| 5,959,583 | A | 9/1999 | Funk |
| 5,963,180 | A | 10/1999 | Leisten |
| 5,966,097 | A | 10/1999 | Fukasawa et al. |
| 5,970,393 | A | 10/1999 | Khorrami et al. |
| 5,977,710 | A | 11/1999 | Kuramoto et al. |
| 5,986,606 | A | 11/1999 | Kossiavas et al. |
| 5,986,608 | A | 11/1999 | Korisch et al. |
| 5,986,614 | A | 11/1999 | Suesada et al. |
| 5,990,848 | A | 11/1999 | Annamaa |

(56) References Cited

U.S. PATENT DOCUMENTS 5,999,132 A 12/1999 Kitchener et al.
6,002,369 A 12/1999 Richard
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,133,879 A 10/2000 Grangeat et al.
6,134,421 A 10/2000 Lee et al.
6,140,973 A 10/2000 Annamaa
6,147,650 A 11/2000 Kawahata et al.
6,157,819 A 12/2000 Vuokko
6,166,694 A 12/2000 Yinh
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,407,171 B1 6/2002 Agarwal et al.
6,417,813 B1 7/2002 Durham
6,421,014 B1 7/2002 Sanad
6,423,915 B1 7/2002 Winter
6,112,108 A1 8/2002 Crowley et al.
6,429,818 B1 8/2002 Johnson et al.
6,452,551 B1 9/2002 Chen
6,452,558 B1 9/2002 Saitou et al.
6,456,249 B1 * 9/2002 Johnson et al. ..... 343/702
6,459,413 B1 10/2002 Tseng et al.
6,462,716 B1 10/2002 Kushihi
6,469,673 B2 10/2002 Kaiponen
6,473,056 B2 10/2002 Annamaa
6,476,769 B1 11/2002 Lehtola
6,480,155 B1 11/2002 Eggleston
6,501,425 B1 12/2002 Nagumo
6,518,925 B1 2/2003 Annamaa
6,529,168 B2 3/2003 Mikkola
6,535,170 B2 3/2003 Sawamura et al.
6,538,604 B1 3/2003 Isohatala
6,549,167 B1 4/2003 Yoon
6,549,169 B1 * 4/2003 Matsuyoshi et al. ..... 343/702
6,556,812 B1 4/2003 Pennanen et al.
6,566,944 B1 5/2003 Pehlke
6,580,396 B2 6/2003 Lin
6,580,397 B2 6/2003 Kuriyama et al.
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,405 B1 9/2003 Mikkonen
6,624,789 B1 9/2003 Kangasvieri
5,442,280 A1 10/2003 Johnson
6,634,564 B2 10/2003 Kuramochi
6,636,181 B2 10/2003 Asano
6,639,559 B2 10/2003 Okabe et al.
6,639,564 B2 10/2003 Johnson
6,646,606 B2 11/2003 Mikkola
6,650,294 B2 11/2003 Ying et al.
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Varjakka
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 Johannes et al.
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,927,792 B1 8/2005 Legay
6,937,196 B2 8/2005 Korva
6,940,458 B2 * 9/2005 Mukai et al. ..... 343/700 MS
6,950,066 B2 9/2005 Hendler et al.
6,950,068 B2 9/2005 Bordi
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,026,994 B2 4/2006 Ikuta et al.
7,026,996 B2 4/2006 Harano
7,031,744 B2 4/2006 Kojima et al.

(56) References Cited

U.S. PATENT DOCUMENTS

| | | | | |
|---|---|---|---|---|
| 7,042,403 | B2 | 5/2006 | Colburn et al. | |
| 7,053,841 | B2 | 5/2006 | Ponce De Leon et al. | |
| 7,054,671 | B2 | 5/2006 | Kaiponen et al. | |
| 7,057,560 | B2 | 6/2006 | Erkocevic | |
| 7,068,230 | B2 | 6/2006 | Qi et al. | |
| 7,081,857 | B2 | 7/2006 | Kinnunen et al. | |
| 7,084,831 | B2 | 8/2006 | Takagi et al. | |
| 7,095,372 | B2 | 8/2006 | Castany et al. | |
| 7,099,690 | B2 | 8/2006 | Milosavljevic | |
| 7,113,133 | B2 | 9/2006 | Chen et al. | |
| 7,119,749 | B2 | 10/2006 | Miyata et al. | |
| 7,126,546 | B2 | 10/2006 | Annamaa | |
| 7,136,019 | B2 | 11/2006 | Mikkola | |
| 7,136,020 | B2 | 11/2006 | Yamaki | |
| 7,142,824 | B2 | 11/2006 | Kojima et al. | |
| 7,148,847 | B2 | 12/2006 | Yuanzhu | |
| 7,148,849 | B2 | 12/2006 | Lin | |
| 7,148,851 | B2 | 12/2006 | Takaki et al. | |
| 7,170,464 | B2 | 1/2007 | Tang et al. | |
| 7,176,838 | B1 | 2/2007 | Kinezos | |
| 7,180,455 | B2 | 2/2007 | Oh et al. | |
| 7,193,574 | B2 | 3/2007 | Chiang et al. | |
| 7,205,942 | B2 | 4/2007 | Wang et al. | |
| 7,218,280 | B2 | 5/2007 | Annamaa | |
| 7,218,282 | B2 | 5/2007 | Humpfer et al. | |
| 7,224,313 | B2 | 5/2007 | McKinzie, III et al. | |
| 7,230,574 | B2 | 6/2007 | Johnson | |
| 7,237,318 | B2 | 7/2007 | Annamaa | |
| 7,256,743 | B2 | 8/2007 | Korva | |
| 7,274,334 | B2 | 9/2007 | O'Riordan et al. | |
| 7,283,097 | B2 | 10/2007 | Wen et al. | |
| 7,289,064 | B2 | 10/2007 | Cheng | |
| 7,292,200 | B2 | 11/2007 | Posluszny et al. | |
| 7,319,432 | B2 | 1/2008 | Andersson | |
| 7,330,153 | B2 | 2/2008 | Rentz | |
| 7,333,067 | B2 | 2/2008 | Hung et al. | |
| 7,339,528 | B2 | 3/2008 | Wang et al. | |
| 7,340,286 | B2 | 3/2008 | Kempele | |
| 7,345,634 | B2 | 3/2008 | Ozkar et al. | |
| 7,352,326 | B2 | 4/2008 | Korva | |
| 7,358,902 | B2 | 4/2008 | Erkocevic | |
| 7,382,319 | B2 | 6/2008 | Kawahata et al. | |
| 7,385,556 | B2 | 6/2008 | Chung et al. | |
| 7,388,543 | B2 | 6/2008 | Vance | |
| 7,391,378 | B2 | 6/2008 | Mikkola | |
| 7,405,702 | B2 | 7/2008 | Annamaa et al. | |
| 7,411,556 | B2 | 8/2008 | Sanz et al. | |
| 7,417,588 | B2 | 8/2008 | Castany et al. | |
| 7,423,592 | B2 | 9/2008 | Pros et al. | |
| 7,432,860 | B2 | 10/2008 | Huynh | |
| 7,439,929 | B2 | 10/2008 | Ozkar | |
| 7,443,343 | B2 * | 10/2008 | Schlegel et al. | 343/700 MS |
| 7,468,700 | B2 | 12/2008 | Milosavlejevic | |
| 7,468,709 | B2 | 12/2008 | Niemi | |
| 7,498,990 | B2 | 3/2009 | Park et al. | |
| 7,501,983 | B2 | 3/2009 | Mikkola | |
| 7,502,598 | B2 | 3/2009 | Kronberger | |
| 7,561,106 | B2 * | 7/2009 | Konishi | 343/700 MS |
| 7,589,678 | B2 | 9/2009 | Perunka | |
| 7,616,158 | B2 | 11/2009 | Mark et al. | |
| 7,633,449 | B2 | 12/2009 | Oh | |
| 7,663,551 | B2 | 2/2010 | Nissinen | |
| 7,679,565 | B2 | 3/2010 | Sorvala | |
| 7,692,543 | B2 | 4/2010 | Copeland | |
| 7,710,325 | B2 | 5/2010 | Cheng | |
| 7,724,204 | B2 | 5/2010 | Annamaa | |
| 7,760,146 | B2 | 7/2010 | Ollikainen | |
| 7,764,245 | B2 | 7/2010 | Loyet | |
| 7,786,938 | B2 | 8/2010 | Sorvala | |
| 7,800,544 | B2 | 9/2010 | Thornell-Pers | |
| 7,830,327 | B2 | 11/2010 | He | |
| 7,889,139 | B2 | 2/2011 | Hobson et al. | |
| 7,889,143 | B2 * | 2/2011 | Milosavljevic et al. | 343/722 |
| 7,901,617 | B2 | 3/2011 | Taylor | |
| 7,916,086 | B2 | 3/2011 | Koskiniemi et al. | |
| 7,963,347 | B2 | 6/2011 | Pabon | |
| 7,973,720 | B2 | 7/2011 | Sorvala | |
| 8,049,670 | B2 | 11/2011 | Jung et al. | |
| 8,179,322 | B2 | 5/2012 | Nissinen | |
| 2001/0050636 | A1 | 12/2001 | Weinberger | |
| 2001/0050654 | A1 | 12/2001 | Killen et al. | |
| 2002/0019247 | A1 | 2/2002 | Egorov | |
| 2002/0145569 | A1 | 10/2002 | Nagumo | |
| 2002/0149538 | A1 | 10/2002 | Tomomatsu et al. | |
| 2002/0183013 | A1 | 12/2002 | Auckland et al. | |
| 2002/0190905 | A1 * | 12/2002 | Flint et al. | 343/702 |
| 2002/0196192 | A1 | 12/2002 | Nagumo et al. | |
| 2003/0092426 | A1 | 5/2003 | Sugimoto et al. | |
| 2003/0146873 | A1 | 8/2003 | Blancho | |
| 2003/0222823 | A1 * | 12/2003 | Flint et al. | 343/702 |
| 2004/0027298 | A1 | 2/2004 | Akihiko et al. | |
| 2004/0075614 | A1 | 4/2004 | Yujiro et al. | |
| 2004/0080457 | A1 | 4/2004 | Guo et al. | |
| 2004/0090378 | A1 | 5/2004 | Dai et al. | |
| 2004/0090382 | A1 | 5/2004 | Kushihi et al. | |
| 2004/0130494 | A1 * | 7/2004 | Fukushima et al. | 343/702 |
| 2004/0145525 | A1 | 7/2004 | Annabi et al. | |
| 2004/0145528 | A1 * | 7/2004 | Mukai et al. | 343/702 |
| 2004/0171403 | A1 | 9/2004 | Mikkola | |
| 2004/0212493 | A1 | 10/2004 | Stilp | |
| 2004/0227669 | A1 * | 11/2004 | Okado | 343/700 MS |
| 2004/0233109 | A1 | 11/2004 | Ying et al. | |
| 2004/0257283 | A1 * | 12/2004 | Asano et al. | 343/702 |
| 2005/0024272 | A1 | 2/2005 | Lorenzo et al. | |
| 2005/0057401 | A1 | 3/2005 | Yuanzhu | |
| 2005/0078037 | A1 | 4/2005 | Leclerc et al. | |
| 2005/0159131 | A1 | 7/2005 | Shibagaki et al. | |
| 2005/0176481 | A1 | 8/2005 | Jeong | |
| 2005/0243001 | A1 | 11/2005 | Chan | |
| 2006/0017621 | A1 | 1/2006 | Okawara et al. | |
| 2006/0071857 | A1 | 4/2006 | Pelzer | |
| 2006/0145924 | A1 | 7/2006 | Chen et al. | |
| 2007/0013589 | A1 | 1/2007 | Park et al. | |
| 2007/0042615 | A1 | 2/2007 | Liao | |
| 2007/0082789 | A1 | 4/2007 | Nissila | |
| 2007/0152881 | A1 | 7/2007 | Chan | |
| 2008/0007459 | A1 | 1/2008 | Koskiniemi et al. | |
| 2008/0042903 | A1 | 2/2008 | Cheng | |
| 2008/0055164 | A1 | 3/2008 | Zhang et al. | |
| 2008/0059106 | A1 | 3/2008 | Wight | |
| 2008/0088511 | A1 | 4/2008 | Sorvala | |
| 2008/0266199 | A1 | 10/2008 | Milosavljevic | |
| 2009/0009415 | A1 | 1/2009 | Tanska | |
| 2009/0135066 | A1 | 5/2009 | Raappana et al. | |
| 2009/0174604 | A1 | 7/2009 | Keskitalo | |
| 2009/0196160 | A1 | 8/2009 | Crombach | |
| 2010/0220016 | A1 | 9/2010 | Nissinen | |
| 2010/0244978 | A1 | 9/2010 | Milosavljevic | |
| 2010/0309092 | A1 | 12/2010 | Lambacka | |
| 2011/0102290 | A1 | 5/2011 | Milosavljevic | |
| 2011/0133994 | A1 | 6/2011 | Korva | |
| 2012/0119955 | A1 | 5/2012 | Milosavljevic | |

FOREIGN PATENT DOCUMENTS

| | | |
|---|---|---|
| CN | 1473377 | 2/2004 |
| CN | 1747234 | 3/2006 |
| CN | 1316797 | 10/2007 |
| CN | 2006/800365574 | 3/2011 |
| DE | 10015583 | 11/2000 |
| DE | 10104862 | 8/2002 |
| DE | 101 50 149 A1 | 4/2003 |
| EP | 0208424 | 1/1987 |
| EP | 0278069 | 8/1988 |
| EP | 0279050 | 8/1988 |
| EP | 0339822 | 3/1989 |
| EP | 0 332 139 | 9/1989 |
| EP | 0 376 643 A2 | 4/1990 |
| EP | 0383292 | 8/1990 |
| EP | 0399975 | 12/1990 |
| EP | 0400872 | 12/1990 |
| EP | 0401839 | 9/1991 |
| EP | 0447218 | 9/1994 |
| EP | 0615285 | 10/1994 |

(56) References Cited

FOREIGN PATENT DOCUMENTS

| | | | |
|---|---|---|---|
| EP | 0621653 | | 2/1995 |
| EP | 0 749 214 | | 12/1996 |
| EP | 0749214 | A2 | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0766339 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0 942 488 | A2 | 9/1999 |
| EP | 1 003 240 | A2 | 5/2000 |
| EP | 0999607 | | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 1 052 723 | | 11/2000 |
| EP | 1052722 | | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1113524 | | 7/2001 |
| EP | 1 128 466 | A2 | 8/2001 |
| EP | 1 139 490 | | 10/2001 |
| EP | 1 146 589 | | 10/2001 |
| EP | 1 148 581 | | 10/2001 |
| EP | 1 162 688 | | 12/2001 |
| EP | 1162688 | | 12/2001 |
| EP | 0993070 | | 4/2002 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1294048 | A2 | 3/2003 |
| EP | 1306922 | | 5/2003 |
| EP | 1 329 980 | | 7/2003 |
| EP | 1329980 | A | 7/2003 |
| EP | 1 351 334 | | 8/2003 |
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |
| EP | 1 445 822 | | 8/2004 |
| EP | 14/45822 | A1 | 8/2004 |
| EP | 1 453 137 | | 9/2004 |
| EP | 1 469 549 | | 10/2004 |
| EP | 1220456 | | 10/2004 |
| EP | 1467456 | | 10/2004 |
| EP | 1 482 592 | | 12/2004 |
| EP | 1 498 984 | | 1/2005 |
| EP | 1 564 839 | | 1/2005 |
| EP | 1170822 | | 4/2005 |
| EP | 1 544 943 | | 6/2005 |
| EP | 1753079 | | 2/2007 |
| EP | 1 791 213 | | 5/2007 |
| EP | 1843432 | | 10/2007 |
| FI | 20020829 | | 11/2003 |
| FI | 20055621 | | 11/2005 |
| FR | 2553584 | | 10/1983 |
| FR | 2873247 | | 1/2006 |
| GB | 2 067 842 | | 7/1981 |
| GB | 2266997 | | 11/1993 |
| GB | 2 360 422 | A | 9/2001 |
| GB | 239246 | | 12/2003 |
| JP | 59202831 | | 11/1984 |
| JP | 600206304 | | 2/1985 |
| JP | 61245704 | | 11/1986 |
| JP | 3280625 | A | 12/1991 |
| JP | 06152463 | | 5/1994 |
| JP | 7131234 | | 5/1995 |
| JP | 7221536 | | 8/1995 |
| JP | 7249923 | | 9/1995 |
| JP | 07307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10 028013 | | 1/1998 |
| JP | 10107671 | | 4/1998 |
| JP | 10173423 | | 6/1998 |
| JP | 100173423 | | 6/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11/004117 | A | 1/1999 |
| JP | 114113 | | 1/1999 |
| JP | 11 068456 | | 3/1999 |
| JP | 11068456 | A | 3/1999 |
| JP | 11127010 | | 5/1999 |
| JP | 11127014 | | 5/1999 |
| JP | 11136025 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 2001326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003124730 | | 4/2003 |
| JP | 2003179426 | | 6/2003 |
| JP | 2003318638 | | 11/2003 |
| JP | 2004112028 | | 4/2004 |
| JP | 2004/363859 | A | 12/2004 |
| JP | 2005/020266 | | 1/2005 |
| JP | 2005005985 | | 1/2005 |
| JP | 2005252661 | | 9/2005 |
| JP | 11355033 | A | 3/2011 |
| KR | 20010080521 | | 8/2001 |
| KR | 10-2006-7027462 | | 12/2002 |
| KR | 20020096016 | | 12/2002 |
| SE | 511900 | | 12/1999 |
| WO | WO 92/00635 | | 1/1992 |
| WO | WO 96/27219 | | 9/1996 |
| WO | 98/01921 | A1 | 1/1998 |
| WO | WO 98/01919 | | 1/1998 |
| WO | 98/37592 | A1 | 8/1998 |
| WO | WO 99/30479 | | 6/1999 |
| WO | WO 00/34916 | | 6/2000 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/08672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067375 | | 8/2002 |
| WO | WO 02/078123 | | 10/2002 |
| WO | WO 02/078124 | | 10/2002 |
| WO | WO 03/094290 | | 11/2003 |
| WO | WO 2004/017462 | | 2/2004 |

(56) References Cited

FOREIGN PATENT DOCUMENTS

| | | | |
|---|---|---|---|
| WO | WO 2004/036778 | | 4/2004 |
| WO | WO 2004/057697 | | 7/2004 |
| WO | 2004/070872 | A1 | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

A Finnish Search Report, dated Sep. 18, 2003, which issued during the prosecution of Finnish Application No. 20030059 which corresponds to the present application.

A Finnish Search Report, dated Sep. 23, 2003, which issued during the prosecution of Finnish Application No. 20030093 which corresponds to the present application.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D, Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, \New compact six-band internal antenna, *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

Hossa, R., A. Byndas, and M. E. Bialkowski, "Improvement of compact internal antenna performance by incorporating open-end slots in ground plane," *IEEE Microwave and Wireless Components Letters*, vol. 14, 283{285, 2004.

I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.

International Preliminary Report on Patentability for International Application No. PCT/FI2004/000554, date of issuance of report May 1, 2006.

Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.

Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.

Kim, Kihong et al., "Integrated Dipole Antennas on Silicon Substrates for Intra-Chip Communication", IEEE, pp. 1582-1585, 1999.

Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.

K-L Wong, *Planar Antennas for Wireless Communications.*, Hoboken, NJ: Willey, 2003, ch. 2.

Lindberg., P. and E. Ojefors, "A bandwidth enhancement technique for mobile handset antennas using wavetraps," *IEEE Transactions on Antennas and Propagation*, vol. 54, 2226{2232, 2006.

Marta Martinez-Vazquez, et al., "Integrated Planar Multiband Antennas for Personal Communication Handsets", *IEEE Trasactions on Antennas and propagation*, vol. 54, No. 2, Feb. 2006.

P. Ciais, et al., "Compact Internal Multiband Antennas for Mobile and WLAN Standards", *Electronic Letters*, vol. 40, No. 15, pp. 920-921, Jul. 2004.

P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.

P. Salonen, et al. "New slot configurations for dual-band planar inverted-F antenna," *Microwave Opt. Technol.*, vol. 28, pp. 293-298, 2001.

Papapolymerou, Ioannis et al., "Micromachined Patch Antennas", IEEE Transactions on Antennas and Propagation, vol. 46, No. 2, pp. 275-283, Feb. 1998.

Park, J. D., N. Kim, "SAR Analysis on Human Head Caused by PCS Handheld Telephone," BEMS 21th Annual Meeting, 166-167, 1999.

Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.

S. Tarvas, et al. "An internal dual-band mobile phone antenna," in *2000 IEEE Antennas Propagat. Soc. Int. Symp. Dig.*, pp. 266-269, Salt Lake City, UT, USA.

Wang, F., Z. Du, Q. Wang, and K. Gong, "Enhanced-bandwidth PIFA with T-shaped ground plane," *Electronics Letters*, vol. 40, 1504-1505, 2004.

Wang, H.; "Dual-Resonance Monopole Antenna with Tuning Stubs"; IEEE Proceedings, Microwaves, Antennas & Propagation, vol. 153, No. 4, Aug. 2006; pp. 395-399.

(56) References Cited

OTHER PUBLICATIONS

Wong, K., et al.; "A Low-Profile Planar Monopole Antenna for Multiband Operation of Mobile Handsets"; IEEE Transactions on Antennas and Propagation, Jan. 2003, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., at al., "A Meandered Loop Antenna for LYE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi Kumar, et al. "Broadband Concentric Rings Fractal Slot Antenna," Department of Electrical Engineering, Indian Institute of Technology, Kanpur-208 016, India, 4 pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "Investigation of Low Profile Antenna Designs for Use in Hand-Held Radios," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring of Antenna with Small Ground Plane," Department of Electronic Engineering, Cheng Shiu University, 3 pgs.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
O. Kivekas, et al; "Frequency-tunable internal antenna for mobile phones," Proceedings of 12emes Journees Internationales de Nice sur les Antennes, 12$^{th}$ Int'l Symposium on Antennas (JINA 2002) vol. 2, 2002, Nice, France, s. 53-56, tiivistelma.

* cited by examiner

MULTIBAND ANTENNA SYSTEM AND METHODS

PRIORITY AND RELATED APPLICATIONS

This application claims priority to International PCT Application No. PCT/FI2006/050403 having an international filing date of Sep. 20, 2006, which claims priority to Finland Patent Application No. 20055527 filed Oct. 3, 2005 entitled "Multiband antenna system", each of the foregoing incorporated herein by reference in its entirety. This application is related to co-owned U.S. patent application Ser. No. 12/080,741 (issued as U.S. Pat. No. 7,889,143) filed contemporaneously herewith and entitled "Multiband Antenna System And Methods", Ser. No. 12/009,009 filed Jan. 15, 2008 and entitled "Dual Antenna Apparatus And Methods", Ser. No. 11/544,173 filed Oct. 5, 2006 and entitled "Multi-Band Antenna With a Common Resonant Feed Structure and Methods", and co-owned and co-pending U.S. patent application Ser. No. 11/603,511 filed Nov. 22, 2006 and entitled "Multiband Antenna Apparatus and Methods", each also incorporated herein by reference in its entirety. This application is also related to co-owned and co-pending U.S. patent application Ser. No. 11/648,429 filed Dec. 28, 2006 and entitled "Antenna, Component And Methods", and Ser. No. 11/648,431 also filed Dec. 28, 2006 and entitled "Chip Antenna Apparatus and Methods", both of which are incorporated herein by reference in their entirety. This application is further related to U.S. patent application Ser. No. 11/901,611 filed Sep. 17, 2007 entitled "Antenna Component and Methods", Ser. No. 11/883,945 filed Aug. 6, 2007 entitled "Internal Monopole Antenna", Ser. No. 11/801,894 filed May 10, 2007 entitled "Antenna Component", and Ser. No. 11/922,976 entitled "Internal multiband antenna and methods" filed Nov. 15, 2005, each of the foregoing incorporated by reference herein in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The invention relates to an internal antenna system of a radio device with separate operating bands. The system is intended for use especially in small-sized mobile stations.

In small-sized, mobile radio devices the antenna is preferably placed inside the casing of the device for convenience. This makes the design of the antenna a more demanding task compared to an external antenna. Extra difficulties in the design are caused when the radio device has to function in a plurality of frequency ranges, the more the wider these ranges or one of them are.

Internal antennas most often have a planar structure, in which case they have a radiating plane and a parallel ground plane at a certain distance from it. The radiating plane is provided with a short-circuit and feed point of the antenna. The short-circuit conductor belonging to the structure extends from the short-circuit point to the ground plane, and the feed conductor of the antenna extends from the feed point to the antenna port of the device. For increasing the number of operating bands of the antenna, the radiating plane can be divided into two or more branches of different length as seen from the short-circuit point. The number of bands can also be increased by a parasitic auxiliary element. As an alternative, a parasitic element can be used for widening an operating band by arranging the resonance frequency corresponding to it relatively close to the resonance frequency corresponding to a branch of the radiating plane.

In this description and the claims, the terms "radiating plane", "radiating element" and "radiator" mean an antenna element, which can function as a part transmitting radio-frequency electromagnetic waves, as a part receiving them or as a part which both transmits and receives them. Correspondingly, "feed conductor" means a conductor which can also function as a receiving conductor.

The antennas of the kind described above have the drawback that their characteristics are insufficient when the number of radio systems in accordance with which the radio device must function increases. The insufficiency appears from that e.g. the matching of the antenna is poor in the band used by one of the radio systems or in a part of at least one of such bands. This drawback can be diminished by providing the antenna structure with a switch by which the operating band of a relatively narrow-band antenna can be displaced from the transmitting band of the radio system to the receiving band and vice versa or to a sub-band within the transmitting or receiving band. However, the switch causes additional losses and thus reduces the efficiency of the antenna. The efficiency of the antenna can thus remain unsatisfactory because of poor matching or switch losses, for example. Said drawbacks are emphasized when the antenna size has to be compromised because of the lack of space. The size is reduced by shortening the distance between the radiating plane and the ground plane or by using dielectric material between them, for example. In addition, these antennas have the drawback that it is difficult to make sufficient isolation between the antenna parts corresponding to different bands.

It is also possible to arrange two radiators in the antenna structure so that they both have a feed conductor of their own. This can be done when the radio device has a separate transmitter and receiver for some radio system. FIG. 1 shows an example of such an antenna structure known from the publication WO 02/078123. It comprises a ground plane 101, a radiating plane 110, a parasitic element 113 of the radiating plane and a segregated radiator 107. The radiating plane has a feed conductor 102 and a short-circuit conductor, and thus it forms a PIFA (Planar Inverted F-Antenna) together with the ground plane. The PIFA has two bands, because the radiating plane is divided into a first 111 and a second 112 branch as seen from the short-circuit and feed point. The first branch functions as a radiator in the frequency range of the GSM900 (Global System for Mobile communications) system and the second branch in the range of the DCS (Digital Cellular Standard) system. The parasitic element 113 is connected to the ground plane and it functions as a radiator in the range of the PCS (Personal Communication Service) system. The segregated radiator 107 has its own feed conductor 103 and short-circuit conductor. Together with the ground plane it forms an IFA, which functions as a Bluetooth antenna. The segregated radiator is located near the radiating plane and its parasitic element so that the short-circuit and feed conductors of the radiating plane, the short-circuit conductor of the parasitic element and the short-circuit and feed conductors of the segregated radiator are in a row in a relatively small area compared to the dimensions of the antenna structure. The support structure of the antenna elements is not visible in the drawing.

The segregated radiator mentioned above, provided with its own feed, is thus for the Bluetooth system. Such a radiator can similarly be e.g. for the WCDMA (Wideband Code Division Multiple Access) system. In general, the use of a segregated radiator provided with its own feed reduces the drawbacks mentioned above to such an extent that the matching can be made good at least in the frequency range of the radio system for which the segregated radiator is provided.

The use of dielectric material for reducing the physical size of the antenna was mentioned above. FIG. 2 shows an example of such a known antenna. This comprises a dielectric substrate 211, a radiator 212 and its feed element 213. The radiator and the feed element are conductor strips on the surface of the substrate. All three together form an antenna component 210, which is mounted on the circuit board PCB of a radio device.

SUMMARY OF THE INVENTION

In a first aspect of the invention, an antenna system of a multiband radio device is disclosed. In one embodiment, the antenna system is implemented in an internal and decentralized way such that the device has a plurality of separate antennas. Each antenna is based on (a) radiating element(s) on the surface of a dielectric substrate. The substrate can be, for example, a piece of ceramics or a part of the outer casing of the device. The antennas are located at suitable places in the device. The operating band of an individual antenna covers the frequency range used by one radio system, the frequency ranges close to each other and used by two different radio systems or only the transmitting or receiving band of the frequency range used by a radio system. If the device has a shared transmitter and a shared receiver for the radio systems using frequency ranges close to each other, there can anyway be a separate antenna for each system or the antenna can also be shared.

The exemplary embodiment of the invention has the advantage that the size of the antennas can be made small. This is due to that when there is a plurality of antennas, a relatively small bandwidth is sufficient for an individual antenna. When the bandwidth is small, a material with higher permittivity can be chosen for the antenna than for an antenna having a wider band, in which case the antenna dimensions can be made correspondingly smaller. In addition, the invention has the advantage that a good matching is achieved on the whole width of the band of each radio system. This is due to that the matching of a separate antenna having a relatively narrow band is easier to arrange than the matching of a combined multiband antenna. The exemplary embodiment of the invention further has the advantage that the antenna system has a good efficiency in different bands. This is partly due to the quality of the matching and partly to that no switches for choosing a sub-band are needed in the structure. Both the matching and the efficiency are also improved by the fact that in a decentralized system the antennas can each be located in a place which is advantageous with regard to its function. The exemplary embodiment of the invention further has the advantage that the isolation between the antennas is good. This is due to the sensible decentralization of the antennas and the fact that a substrate with a relatively high permittivity collapses the near field of the antenna.

In another aspect of the invention, an internal antenna system of a radio device is disclosed. In one embodiment, the system comprises: a ground plane; and at least two antenna components, each of the antenna components comprising at least one radiating element. The ground plane comprises a dimension, the ground plane dimension being equal to at least a combined length of the radiating elements; and the ground plane and the at least two radiating elements form at least two substantially separate operating bands.

In one variant, each of the radiating elements comprises: a conductor; and a dielectric substrate. The conductor is disposed on the dielectric substrate.

In another variant, the radiating elements are substantially similar in size so as to resonate within a substantially similar and narrow frequency range.

In yet another variant, at least one of the antenna components is located on a circuit board of the radio device.

In a further variant, at least one of the antenna components is disposed on a surface of an internal frame of the radio device.

In still another variant, at least one of the operating bands comprises a frequency range used by at least one radio system.

In a further variant, the operating bands comprise frequency ranges used by at least two separate systems. For example, at least one of the operating bands comprises a transmitting band in a frequency range used by a radio system, and at least one of the operating bands comprises a receiving band of the same frequency range. As another option, at least one of the operating bands comprises the receiving band in a frequency range used by the radio system to implement spatial diversity for at least a received signal.

In another variant, the substrate comprises a ceramic.

In a further embodiment, the substrate is disposed at least partly on an outer casing of the radio device. In another embodiment, the internal antenna system of a radio device, comprises: a circuit board comprising a conductive surface and further comprising a ground plane; a frame, the frame surrounding at least a portion of the circuit board; a casing disposed at least partly about the circuit board and the frame; and a plurality of antennas, each of the antennas comprising at least two radiating elements. The ground plane and the radiating elements form at least two separate operating bands.

In one variant, the plurality of antennas comprises: a first antenna disposed substantially centered at a first end of the circuit board; a second antenna disposed proximate a first corner of the circuit board; and a third antenna disposed proximate a second corner of the circuit board, and perpendicular in orientation with respect to the second antenna.

In another variant, the plurality of antennas further comprises: a fourth antenna disposed proximate to a first long side of the circuit board; a fifth antenna disposed proximate a second long side of the circuit board, and substantially parallel to the fourth antenna; and a sixth antenna disposed on a surface of the frame.

In still a further variant, the ground plane comprises a first distance, the first distance being equal to at least a combined length of the radiating elements.

In yet another variant, the radiating elements comprise: a conductor; and a dielectric substrate; the conductor is disposed on the dielectric substrate. The substrate may be for example ceramic.

In another variant, the radiating elements are substantially similar in size so as to resonate within a substantially similar frequency range.

In yet another variant, the casing further comprises a conductive material, the casing further being adapted to function as a substrate of the antenna system.

In still another variant, at least one of the operating bands includes a frequency range used by at least one radio system.

In yet a further variant, the operating bands comprise frequency ranges used by at least two separate systems. For example, at least one of the operating bands comprises a transmitting band in the frequency range used by a radio system, and at least one of the operating bands comprises a receiving band of the same frequency range. As another example, at least one of the operating bands comprises the receiving band in the frequency range used by the radio system to implement a spatial diversity plan.

In another aspect of the invention, a method of operating an antenna system is disclosed. In one embodiment, the system comprises at least two antennas, and the method comprises: operating the antenna system in a first state, the first state comprising utilizing a first one of the at least two antennas, the first antenna comprising at least two operating bands; switching the state of the antenna system; and operating the antenna system in a second state, the second state comprising utilizing a second one of the at least two antennas, the second antenna component comprising at least two operating bands. At least two operating bands of the second antenna are different than the at least two operating bands of the first antenna.

In one variant, the antenna system comprises at least one operating band for a GSM 850 system.

In another variant, the antenna system comprises at least one operating band for a GSM 900 system.

In yet another variant, the antenna system comprises at least one operating band for a GSM 1800 system.

In still a further variant, the antenna system comprises at least one operating band for a WCDMA system.

In a further variant, the antenna system comprises three antennas, the first antenna comprising at least one operating band for a GSM 850 system and for a GSM 900 system, the second antenna comprising at least one operating band for a GSM 1800 system and for a GSM 1900 system, and the third antenna comprising at least one operating band for the WCDMA system.

In another aspect, an internal antenna system of a radio device is disclosed, comprising a ground plane and at least two radiating elements to form at least two separate operating bands, which cover the frequency ranges used by at least two different systems characterized in that each radiating element is a conductor on a surface of a dielectric substrate. The radiating elements form together with the substrates and the ground plane at least two separate antennas, which have different operating bands, and a distance along the ground plane between two radiators belonging to different antennas is at least the combined length of these radiators.

In one variant, the substrate of an individual antenna and the at least one radiating element on the surface of the substrate constitute a unitary, chip-type antenna component.

In another variant, at least one of the antenna components is located on a circuit board of the radio device.

In yet another variant, at least one of the antenna components is on a surface of an internal frame of the radio device.

In a further variant, an operating band of an antenna belonging to the antenna system covers a frequency range used by at least one radio system.

In another variant, an operating band of an antenna belonging to the antenna system covers a transmitting band in the frequency range used by a radio system, and an operating band of another antenna belonging to the antenna system covers a receiving band of the same frequency range.

In yet another variant, the substrate of an individual antenna is a part of an outer casing of the radio device.

In yet another aspect of the invention, a multiband antenna system is disclosed. In one embodiment, the system comprises: at least one dielectric substrate; a ground plane; and a plurality of radiating elements disposed at least partly on the at least one substrate, the plurality of radiating elements being disposed substantially distant from one another so as to produce substantially dedicated ground planes within the ground plane for respective ones of the radiating elements.

In one variant, the at least one substrate comprises a part of the outer casing of a mobile communications device.

In another embodiment, the multiband antenna system comprises: at least one dielectric substrate; and a plurality of high permittivity, low-bandwidth radiating elements disposed at least partly on the at least one substrate, the number of the plurality being sufficient so as to permit a size of each of the radiating elements to be smaller than that necessary if a smaller number were utilized.

In yet another embodiment, the multiband antenna system is matched, and has a plurality of radio frequency bands associated therewith, and comprises: at least one dielectric substrate; and a plurality of substantially discrete low frequency bandwidth radiating elements disposed at least partly on the at least one substrate. Use of the plurality of substantially discrete low bandwidth radiating elements allows for the matching.

DETAILED DESCRIPTION OF THE INVENTION

Reference is now made to the drawings wherein like numerals refer to like parts throughout.

Figure 1:
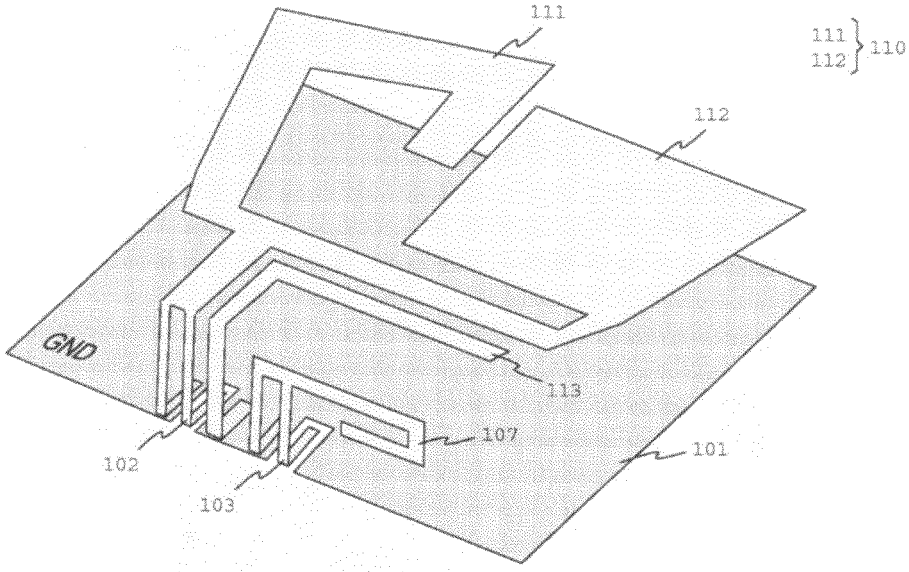
Fig. 1 PRIOR ART
FIG. 1 shows an example of a known multiband antenna.
Figure 2:
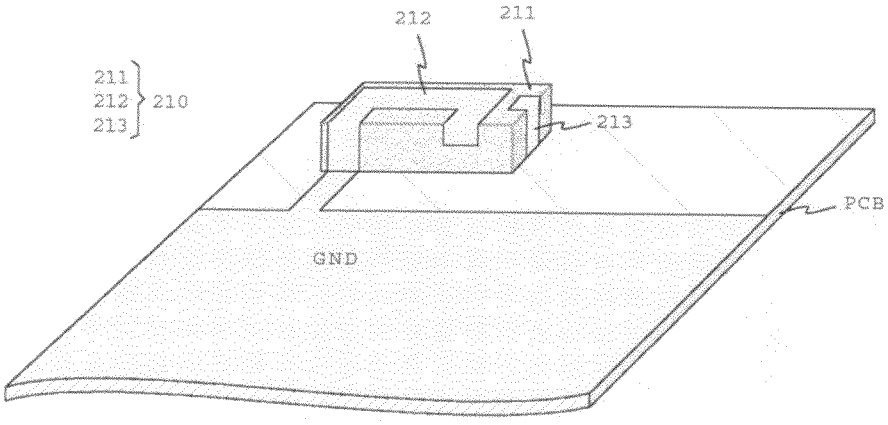
Fig. 2 PRIOR ART
FIG. 2 shows an example of a known antenna component using a dielectric substrate.

FIGS. 1 and 2 were already described in connection with the prior art.

Figure 3:
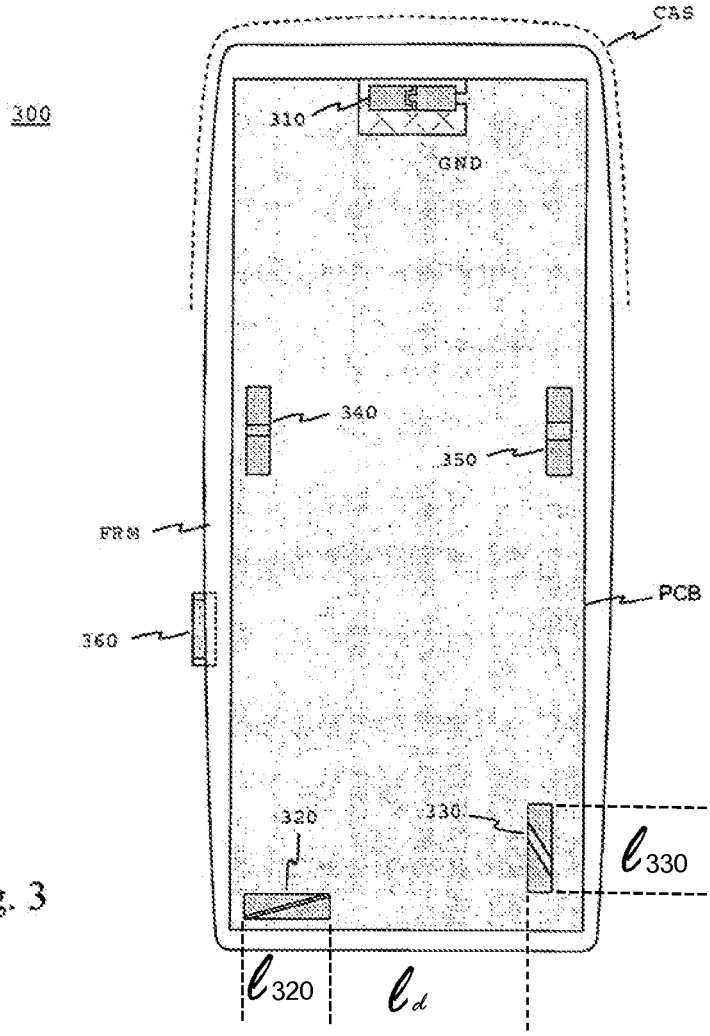
FIG. 3 shows an example of the placement of the antennas in an antenna system according to the invention.

FIG. 3 shows an example of an antenna system according to the invention as a layout drawing. There is a radio device 300 with a circuit board PCB, plastic frame FRM and casing CAS in the drawing. A large part of the surface of the circuit board on the side visible in the drawing consists of a conductive ground plane GND. In this example the antenna system includes six antennas. Each one of these comprises an elongated antenna component with a ceramic substrate and two radiating elements. The ground plane around the antenna component is also considered to be a part of the antenna here. In this example, the radiating elements of each antenna component are of the same size so that they resonate in the same, relatively narrow frequency range. The feed conductor of an antenna is connected to one element, and the other element is parasitic.

The first 310, the second 320, the third 330, the fourth 340 and the fifth 350 antenna component are mounted on the same side of the circuit board PCB, visible in the drawing. The first antenna component 310 is located in the middle of the first end of the circuit board, parallel with the end. The second antenna component 320 is located in a corner defined by the second end and the first long side of the circuit board, parallel with the end. The third antenna component 330 is located near the corner defined by the second end and the second long side of the circuit board, parallel with the long side. The fourth antenna component 340 is located beside the first long side of the circuit board parallel with it, slightly closer to the first than the second end. The fifth antenna component 350 is located beside the second long side of the circuit board parallel with it, opposite to the fourth antenna component. The sixth antenna component 360 is mounted on the side surface of the frame FRM, which surface is perpendicular to the plane of the circuit board. The antenna components are located at places which are advantageous with regard to the other RF parts and so that they do not much interfere with each other.

FIG. 3 also shows an example of the ground arrangement of the antennas. The ground plane of the surface of the circuit board has been removed from below and beside the first antenna component 310 to a certain distance. However, a narrow part of the ground plane extends to one or more points of the radiators. Such an arrangement increases the electric size of the antenna compared to that the ground plane would continue as wide to the area under the component. In that case e.g. the height of an antenna component operating in a certain frequency range can be correspondingly reduced. The other antennas can have a similar ground arrangement. In theory, the whole ground plane is naturally shared between all the antennas. In practice, the system has mainly antenna-dedicated ground planes, because of the decentralization of the antenna components. This becomes evident from the fact that the distance along the ground plane between two radiators ($l_d$) belonging to different antennas is at least the combined length of these radiators (e.g., $l_{320}+l_{330}\leq l_d$).

The antennas according to FIG. 3 can be designed e.g. as follows:

- the antenna based on the component 310 is an antenna for the GSM850 system;
- the antenna based on the component 320 is an antenna for the GSM900 system;
- the antenna based on the component 330 is an antenna for the GSM1800 system;
- the antenna based on the component 340 is a transmitting antenna for the WCDMA system;
- the antenna based on the component 350 is a receiving antenna for the WCDMA system;
- the antenna based on the component 360 is an antenna for the GSM1900 system.

Figure 4:
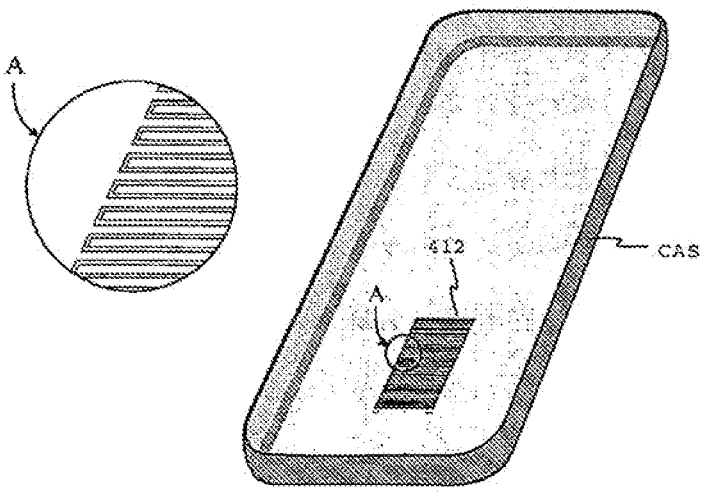
FIG. 4 shows another example of the placement of an antenna belonging to the antenna system according to the invention.

FIG. 4 shows another example of the placement of an antenna belonging to the antenna system according to the invention. The rear portion CAS of the outer casing of a radio device and a radiator 412 on its inner surface are seen in the drawing. In this example the radiator is a dense meander pattern by shape, and it has been implemented by growing conductor material on the surface of the casing. Thus the part of the casing under the radiator functions as the substrate belonging to the antenna.

Figure 5A:
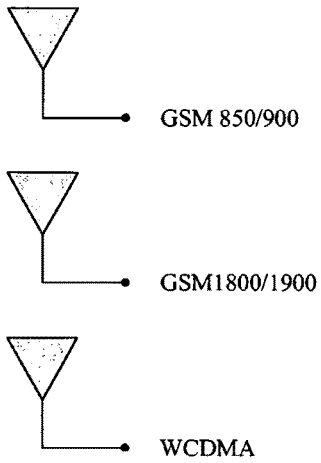
FIGS. 5*a-d* show examples of the composition of an antenna system according to the invention.
Figure 5B:
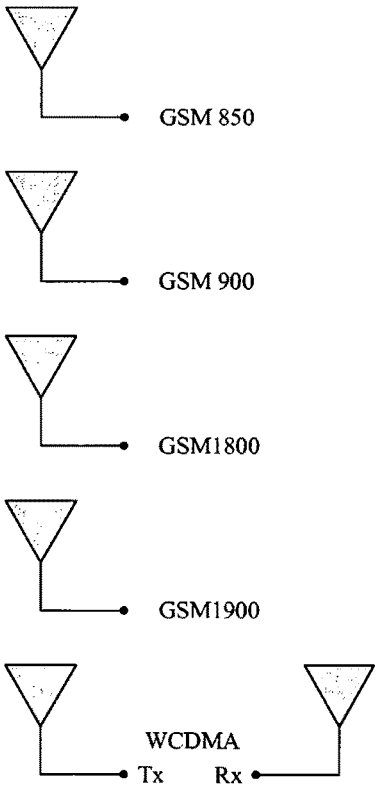
Figure 5C:
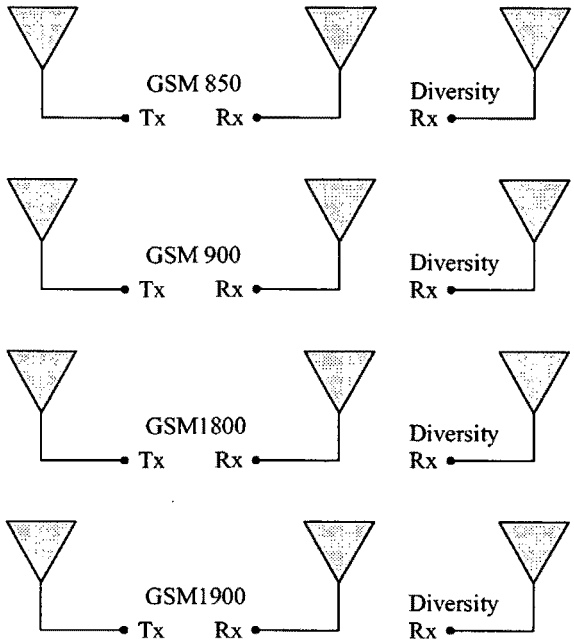
Figure 5D:
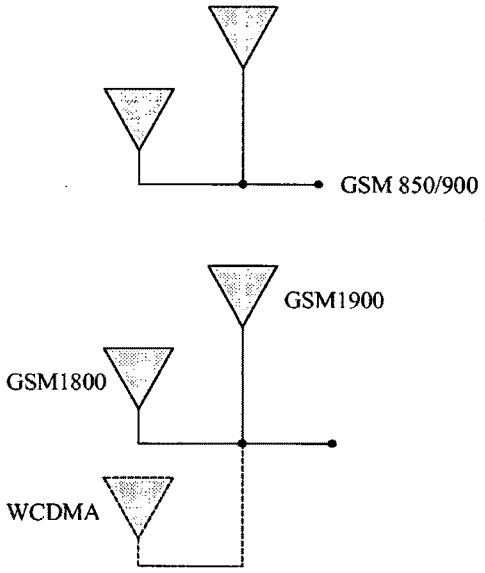

FIGS. 5*a*-5*d* show examples of the composition of the antenna system according to the invention as schematic diagrams. In FIG. 5*a* there are three antennas. One of them is shared between the GSM850 and GSM900 systems, the second is shared between the GSM1800 and GSM1900 systems, and the third is for the WCDMA system. In FIG. 5*b*, there are six antennas for the same bands as above in the example mentioned in the description of FIG. 3. So, one of them is for the GSM850 system, the second for the GSM900, the third for the GSM1800, the fourth for the GSM1900, the fifth for the transmitting side of the WCDMA system, and the sixth for the receiving side of the WCDMA system, listed in the order of FIG. 5*b*. In FIG. 5*c* there are twelve antennas. One of them is for the transmitting side of the GSM850 system, and the second and the third for the receiving side of the GSM850 system. The latter two are used to implement the space diversity in the receiving. There is a corresponding group of three antennas for the GSM900, GSM1800 and GSM1900 system as well. FIG. 5*d* presents a modification of the composition according to FIG. 5*a*. Now the all four GSM systems have their own antenna. However, the GSM850 and GSM900 antennas, the operating bands of which are close to each other, are connected to the same feed line. After the separation of the transfer directions, the antennas then become connected to the shared transmitter and the shared receiver of these systems. In the same way the GSM1800 and GSM1900 antennas, the operating bands of which are close to each other, are connected to a shared feed line. The WCDMA antenna can also be connected to this line.

Figure 6:
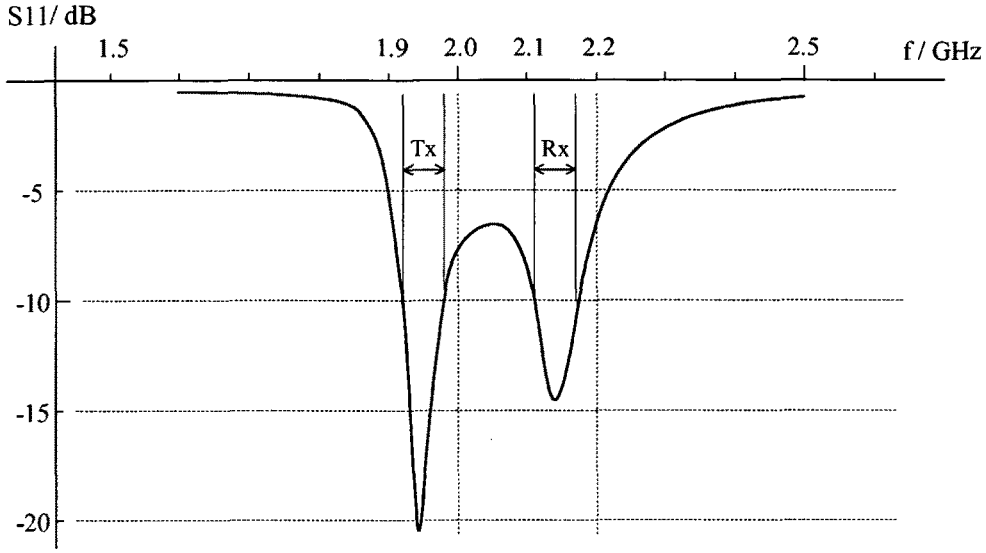
FIG. 6 shows an example of the matching of a pair of antennas in an antenna system according to FIG. 3.

FIG. 6 presents an example of the matching of the antenna system according to FIG. 3 for the antennas corresponding to the fourth 340 and the fifth 350 antenna component, when these are designed to function as the transmitting and receiving antennas of the WCDMA system. The substrate of the antenna components is of a ceramics, and its dimensions are $10\cdot3\cdot2$ mm$^3$ (length, width, height). The figure shows the curve of the reflection coefficient S11 as a function of frequency. It is seen from the curve that the reflection coefficient is −10 dB or better in the range of both the transmitting and the receiving band. The matching of the antenna pair is then good.

Figure 7:
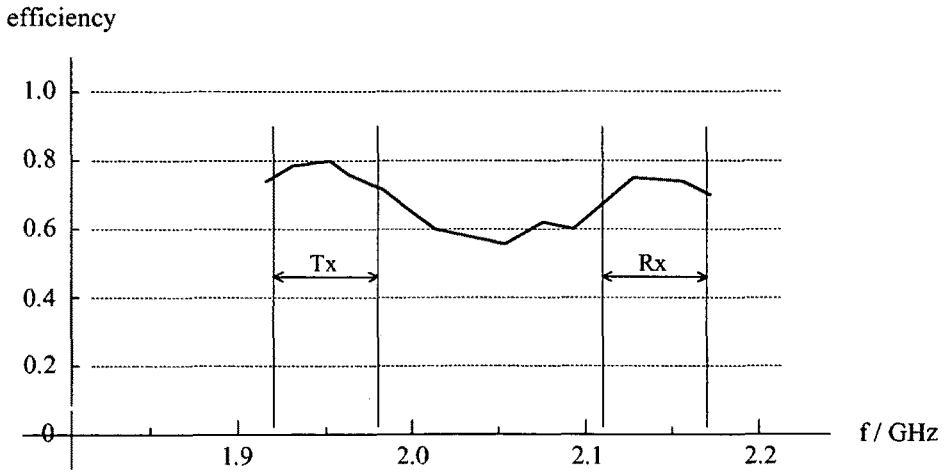
FIG. 7 shows an example of the efficiency of a pair of antennas in an antenna system according to FIG. 3.

FIG. 7 shows a curve of the efficiency of the same antenna pair to which FIG. 6 applies as a function of frequency. It is seen that the efficiency is approx. 0.76 on the average in the transmitting band and approx. 0.72 in the receiving band. The efficiency of the antenna pair is thus excellent considering the small size of the antenna components. The maximum gain of the transmitting antenna is approx. 1.3 dB and the maximum gain of the receiving antenna approx. 2.3 dB on an average as measured in free space A decentralized antenna system according to the invention has been described above. As appears from the examples described, the number and the location of the antennas can vary greatly. The invention does not limit the method of manufacture of individual antenna components. The manufacture can take place for example by coating a piece of ceramics partly with conductive material or by growing a metal layer on the surface of e.g. silicon and removing a part of it by the technique used in the manufacture of semiconductor components. The inventive idea can be applied in different ways within the scope defined by the independent claim 1.

The invention claimed is:

1. An internal antenna system for use in a radio device, comprising:

- a circuit board comprising a conductive surface and further comprising a ground plane;
- a frame, said frame surrounding at least a portion of said circuit board;
- a casing disposed at least partly about said circuit board and said frame; and
- a plurality of antennas, each of said antennas comprising at least two radiating elements, said plurality of antennas comprising:
  - a first antenna disposed substantially centered at a first end of said circuit board;
  - a second antenna disposed proximate a first corner of said circuit board;
  - a third antenna disposed proximate a second corner of said circuit board, and perpendicular in orientation with respect to said second antenna;
  - a fourth antenna disposed proximate to a first long side of said circuit board;

a fifth antenna disposed proximate a second long side of said circuit board, and substantially parallel to said fourth antenna; and a sixth antenna disposed on a surface of said frame;

wherein said ground plane and said radiating elements are configured to form at least two separate operating bands when one or more signals are applied thereto.

2. The antenna system of claim 1, wherein said ground plane comprises a first distance, said first distance being equal to at least a combined length of said radiating elements.

3. The antenna system of claim 1, wherein said radiating elements comprise:

a conductor; and a dielectric substrate;

wherein said conductor is disposed on said dielectric substrate.

4. The antenna system of claim 3, wherein said substrate comprises a ceramic substrate.

5. The antenna system of claim 3, wherein said radiating elements are substantially similar in size so as to enable resonation within a substantially similar frequency range.

6. The antenna system of claim 1, wherein said casing further comprises a conductive material, said casing further being adapted to function as a substrate of said antenna system.

7. The antenna system of claim 1, wherein at least one of said operating bands includes a frequency range used by at least one radio system.

8. The antenna system of claim 1, wherein said operating bands comprise frequency ranges used by at least two separate systems.

9. The antenna system of claim 8, wherein at least one of said operating bands comprises a transmitting band in the frequency range used by a radio system, and at least one of said operating bands comprises a receiving band of the same frequency range.

10. The antenna system of claim 8, wherein at least one of said operating bands comprises the receiving band in the frequency range used by said radio system to implement a spatial diversity plan.

11. An internal antenna system of a radio device, comprising:

a circuit board comprising a conductive surface and further comprising a ground plane;

a frame, said frame configured to surround at least a portion of said circuit board;

a easing disposed at least partly about said circuit board and said frame; and a plurality of antennas, each of said antennas comprising at least two radiating elements, said plurality of antennas comprising:

a first antenna disposed substantially centered at a first end of said circuit board;

a second antenna disposed proximate a first corner of said circuit board;

a third antenna disposed proximate a second corner of said circuit board, and perpendicular in orientation with respect to said second antenna;

a fourth antenna disposed proximate to a first long side of said circuit board;

a fifth antenna disposed proximate a second long side of said circuit board, and substantially parallel to said fourth antenna; and a sixth antenna disposed on a surface of said frame;

wherein said ground plane and said radiating elements form at least two separate operating bands and a distance along said ground plane between said at least two radiating elements of different ones of said plurality of antennas is equal to, or greater than, a sum of a length of a first radiating element of a first antenna of said plurality of antennas and a length of a second radiating element of a second antenna of said plurality of antennas.

12. The antenna system of claim 11, wherein each of said radiating elements comprise:

a conductor; and a dielectric substrate;

wherein said conductor is disposed on said dielectric substrate.

13. The antenna system of claim 12, wherein said dielectric substrate comprises a ceramic substrate.

14. The antenna system of claim 12, wherein each of said radiating elements are substantially similar in size so as to resonate within a substantially similar frequency range.

15. The antenna system of claim 11, wherein said casing further comprises a conductive material, said casing further being adapted to function as a substrate of said internal antenna system.

16. The antenna system of claim 11, wherein at least one of said operating bands includes a frequency range used at least one radio system.

17. The antenna system of claim 16, wherein at least one of said operating bands comprises a transmitting band in the frequency range used by said at least one radio system, and at least one other of said operating bands comprises a receiving band of the same frequency range.

18. The antenna system of claim 17, wherein the receiving band in the frequency range used by the at least one radio system is used to implement a spatial diversity plan.

19. The antenna system of claim 11, wherein said operating bands comprise frequency ranges used by at least two separate radio systems.

* * * * *